United States Patent [19]

Kipphan et al.

[11] Patent Number: 4,955,290

[45] Date of Patent: Sep. 11, 1990

[54] ELECTRONIC MULTIMACHINE OPERATING SYSTEM FOR REMOTELY CONTROLLING PRINTING MACHINES

[75] Inventors: Helmut Kipphan, Schwetzingen; Gerhard Loffler, Walldorf, both of Fed. Rep. of Germany

[73] Assignee: Heidelberger Druckmaschinen AG, Heidelberg, Fed. Rep. of Germany

[21] Appl. No.: 217,541

[22] Filed: Jul. 11, 1988

Related U.S. Application Data

[63] Continuation-in-part of Ser. No. 902,526, Sep. 2, 1986, abandoned, which is a continuation-in-part of Ser. No. 705,369, Feb. 22, 1985, abandoned, which is a continuation-in-part of Ser. No. 500,776, Jun. 3, 1983, abandoned.

[30] Foreign Application Priority Data

Jun. 3, 1982 [DE] Fed. Rep. of Germany ..... 3220803

[51] Int. Cl.[5] ..... B41F 5/06; B41F 33/16

[52] U.S. Cl. ..... 101/183; 101/365

[58] Field of Search ..... 101/181, 365, 216, 212, 101/174, 177, 183, 184, 136, 137, 138–140; 364/519, 526

[56] References Cited

U.S. PATENT DOCUMENTS

| | | | |
|---|---|---|---|
| 3,614,738 | 10/1971 | Slavin | 340/825.39 |
| 3,835,777 | 9/1974 | Krygeris . | |
| 3,930,447 | 1/1976 | Murray | 101/365 |
| 4,200,932 | 4/1980 | Schramm et al. | 364/519 |

FOREIGN PATENT DOCUMENTS

| | | | |
|---|---|---|---|
| 557283 | 12/1983 | Australia . | |
| 3220803 | 12/1983 | Fed. Rep. of Germany | 101/365 |
| 1484947 | 9/1977 | United Kingdom . | |
| 2000082 | 1/1979 | United Kingdom | 101/181 |
| 2024457 | 1/1980 | United Kingdom | 101/181 |
| 2043883 | 10/1980 | United Kingdom . | |
| 2080201 | 2/1982 | United Kingdom | 101/DIG. 47 |

*Primary Examiner*—J. Reed Fisher

*Attorney, Agent, or Firm*—Herbert L. Lerner; Laurence A. Greenberg

[57] ABSTRACT

Multimachine operating system for remotely controlling printing machines including a central ink density measuring installation, and at least one terminal of a respective remote-control desk terminal electrically couplable to the ink density measuring installation, and a viewing screen terminal visually couplable to the control desk, the at least one terminal constituting one of a plurality thereof respectively assigned to a corresponding plurality of printing machines and couplable to the central ink density measuring installation.

8 Claims, 5 Drawing Sheets

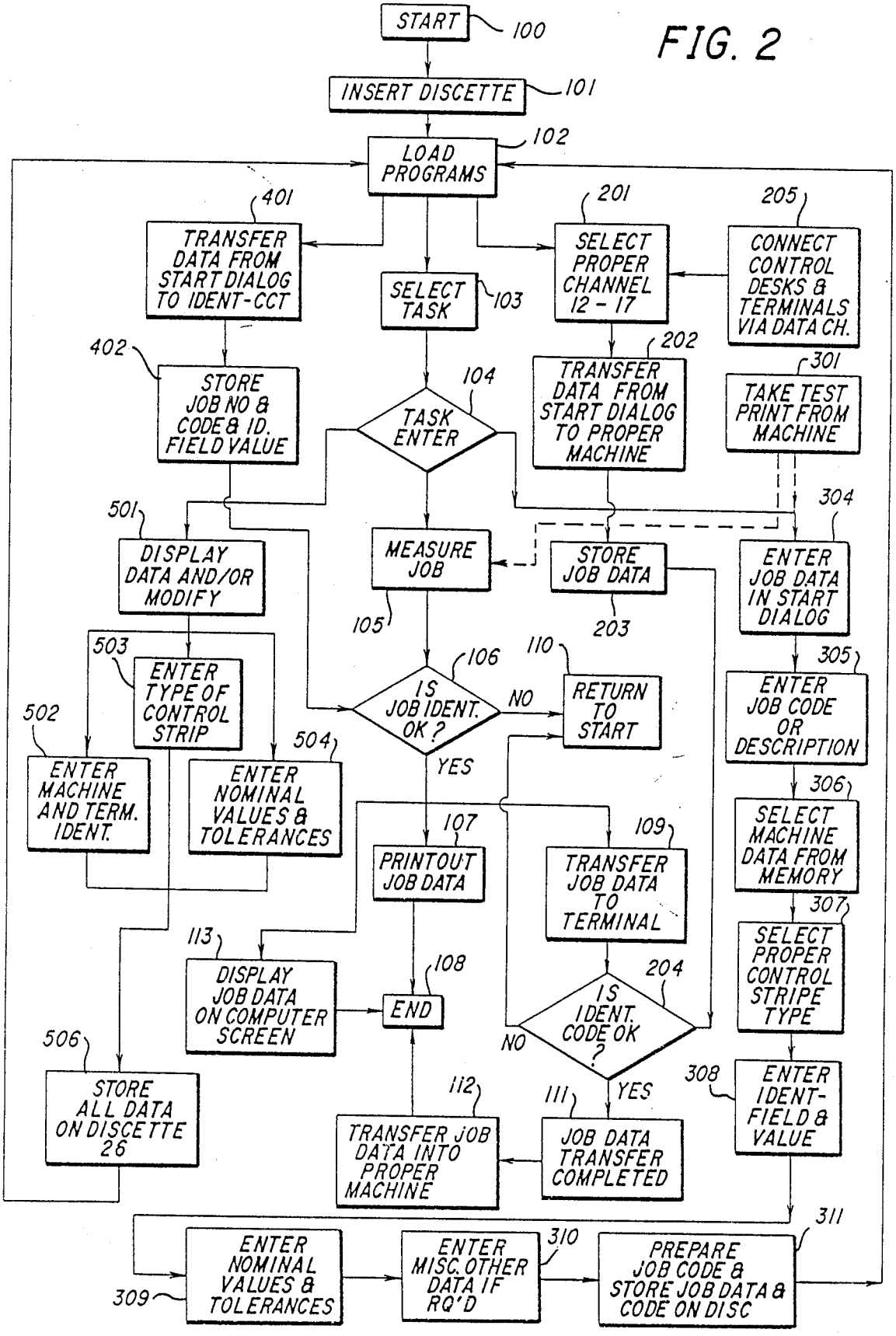
FIG. 2
START
100
INSERT DISCETTE
101
LOAD PROGRAMS
102
401
TRANSFER DATA FROM START DIALOG TO IDENT-CCT
SELECT TASK
103
201
SELECT PROPER CHANNEL 12 - 17
205
CONNECT CONTROL DESKS & TERMINALS VIA DATA CH.
402
STORE JOB NO & CODE & ID. FIELD VALUE
104
TASK ENTER
202
TRANSFER DATA FROM START DIALOG TO PROPER MACHINE
301
TAKE TEST PRINT FROM MACHINE
501
DISPLAY DATA AND/OR MODIFY
MEASURE JOB
105
STORE JOB DATA
203
304
ENTER JOB DATA IN START DIALOG
503
ENTER TYPE OF CONTROL STRIP
106
IS JOB IDENT. OK ?
NO
110
RETURN TO START
YES
305
ENTER JOB CODE OR DESCRIPTION
502
ENTER MACHINE AND TERM. IDENT.
504
ENTER NOMINAL VALUES & TOLERANCES
107
PRINTOUT JOB DATA
109
TRANSFER JOB DATA TO TERMINAL
306
SELECT MACHINE DATA FROM MEMORY
307
SELECT PROPER CONTROL STRIPE TYPE
113
DISPLAY JOB DATA ON COMPUTER SCREEN
108
END
204
IS IDENT. CODE OK ?
NO
YES
506
STORE ALL DATA ON DISCETTE 26
112
TRANSFER JOB DATA INTO PROPER MACHINE
111
JOB DATA TRANSFER COMPLETED
308
ENTER IDENT-FIELD & VALUE
311
309
ENTER NOMINAL VALUES & TOLERANCES
ENTER MISC. OTHER DATA IF RQ'D
310
PREPARE JOB CODE & STORE JOB DATA & CODE ON DISC

ELECTRONIC MULTIMACHINE OPERATING SYSTEM FOR REMOTELY CONTROLLING PRINTING MACHINES

BACKGROUND

This is a continuation-in-part of patent application Ser. No. 902,526. filed Sept. 2, 1986, now abandoned, which is a continuation-in-part of Ser. No. 705,369 filed Feb. 22, 1985, now abandoned, which was a continuation-in-part of patent application, Ser. No. 500,776 filed June 3, 1983, now abandoned.

The invention relates to multimachine operating systems for remotely controlling printing machines.

It is well known that in the course of the progressive automatization developed for printing machines for supporting the work of the operating personnel as well as for shortening machine make-ready times before starting a printing, job to perform by remote control from a computer-supported control desk of the printing machine, the presetting of the ink control members of the printing machine. It is also well known to continue the adjusting of the ink feed during the printing process by such automation means. This requires, however, the availability of data for ink density values for the printed product, to which end, partially or fully automated ink density measuring devices are required. These devices also operate with computer support and provide a high degree of automation.

Such ink density measuring devices, especially for measuring the so-called printing control strips, for quality control of printed products, conventionally include a measuring desk for measuring the ink densities of a print and a control desk combined with the printing machine for adjusting the ink feed. These control desks are usually located spatially and electrically separate from the printing machine. These measuring and control desks may alternatively be mechanically connected directly to one another so that the such connected measuring and control desk is preferably assigned to a specific printing machine. In a free-standing measuring desk with display and output units integrated with it, it is however possible in principle to perform the quality controls for several printing machines by measuring the printing control strips printed by each of these machines. Measuring of a respective printing job is, for example, possible with a scanning densitometer of the IPEX 80 type, introduced by the firm Grapho-Metronic.

PRIOR ART

Applicant is aware of the following prior art related to the instant disclosure:

United Kingdom Patent No. 2 024 457 A by Palmatier et al, who shows a single printing machine with electronic controls for ink distribution and not multimachine operation based on a common measuring and control console;

United Kingdom Patent No. 2 000 082 A by Dorn et al who also shows a single printing machine combined with a scanning device and microcomputers for controlling the ink feed;

U.S. Pat. No. 4,200,932 by Schramm also shows a single printing machine with a test console and a microcomputer for controlling the various machine functions;

U.S. Pat. No. 3,930,447 by Murray, who also shows a single printing machine with a control desk and electronic controls for controlling the printing machine.

U.S. Pat. No. 3,614,738 by Slavin who shows a method of controlling a number of electrically controllable systems from a single control panel by means of a multiplexing method.

U.S. Pat. No. 3,774,536 by Raymond et al shows a printing press control system for controlling a single printing machine having multiple printing units in which each unit typically prints a separate color, and in which the entire machine is controlled from two consoles common to the entire machine.

SUMMARY OF THE INVENTION

The instant invention is related to printing of print jobs on different printing machines of different construction. In large printing establishments it is quite common to have a number of different printing machines that have different mechanical machine characteristics that are available for printing a multiplicity of constantly arriving printing jobs that again all have individual characteristics.

The mechanical machine characteristics typically include such parameters as ink feed settings in a number of parallel ink zones and adjustment of the format of the printed job, and also the settings of several other machine functions such as the lateral and peripheral registers that control the exact overlap of the various colors as they are successively printed onto the paper, and others.

The individual print jobs have various characteristics such as the format of the print length and width, and also the distribution of the various ink colors in individual parallel ink zones along the print. In order to determine the proper ink distribution, it is known to measure the so-called color density of a good copy of the print on an ink density measuring device such as a densitometer that can scan the entire good copy with photo cells and suitable electronic circuitry and on that basis produce quantitative figures for the ink feed required for the various color inks to be used in printing the print.

With such ink density measuring devices, the operator thereof must in suitable manner initialize the device, for example, by means of its keyboard or by means of a special magnetic card inserted into the device, and he may then receive the measurement result, for example, in the form of lists, in the following called protocol print-outs, and apply them manually to the control desk of the printing machine selected to print the particular job. Because the cost of partially or fully automated ink density measuring devices is relatively high depending on their degree of automation, their cost is often too high to justify their installation in each printing machine. Also pressrooms often lack space for installing many measuring desks; therefore such forced assignment of an ink density measuring desk to a corresponding printing machine, may result in lack of flexibility with respect to format, printing control strips, number of colors and printings, and therefore relatively poor use is made of an expensive ink density measuring device.

Starting from this state of the art, it is an object of the invention to provide a multimachine operating system for remotely controlling printing machines having a common ink measuring device which, with a minimum of expense and manufacturing costs, simultaneously can be used to adjust the inking controls of several printing machines.

It is another object of the invention to provide such a system wherein the inking controls of several printing machines in spatially limited printing machine plants or rooms can be performed simultaneously without necessity for expanded space.

It is a further feature of the invention to provide a choice between several modes for transferring information and measurement values for a printed product to the respective printing machine.

It is an additional feature of the invention to accommodate already existing control desks for printing machines which were not originally arranged for multimachine operation, by providing an economical method of providing flexible linkage, coupling or "association" between a measuring desk and a selected machine control desk which is suited for retrofitting, so that a common measuring desk can be integrated with multiple printing machines without great additional effort for multi-machine operation for the purpose of more rapidly attaining an optimized inking process.

Yet another feature of the invention is to provide a system wherein a capability of centrally monitoring the inking of all the printing machines is provided in the form of a central control desk.

Yet a further feature of the invention is to provide a system wherein the correct assignment of a measured printed product to the respective printing machine is always maintained, and preferably such that the recognition of the correct assignment is effected automatically.

With the foregoing and other objects in view, there is provided, in accordance with the invention, a multi-printing-machine operating system for remotely controlling printing machines which includes a central ink density measuring installation, and at least one remote control terminal associated with each printing machine, that is capable of being electrically coupled or "linked" to the ink density measuring installation and has a viewing screen for visually coupling the ink density measuring installation with the respective printing machine.

Through such an operating system, according to the invention, the best possible utilization of a common ink density measuring installation is assured, and a reasonable cost-use ratio is attained. Further still, three information transfer modes are available for selectively passing information from the measuring desk to the respective printing machine, and thereby for direct further processing of the ink density measurement values for adjusting the ink distribution of the machine.

In accordance with another feature of the invention there is provided means for automatically recognizing the correctness of the assignment between a respective printing machine and a respective printed product measured by the central ink density measuring installation which include the use of an identification field on each printed product that, by its location, is correlated with data contained in a data carrier, for confirming or rejecting the correctness of the assignment. The term "assignment" refers to the feature that the data carrier which is used for transferring the printing machine setting data for a particular printing job includes a feature that distinctly ties together the specific data set contained on the carrier and a particular print being printed, so that it is impossible for the machine operator to insert a wrong set of data, e.g. a set of data for another print, to a machine being set for printing said particular job.

In accordance with a further feature of the invention there is provided a multi-channel interface multiplexer for electrically coupling or linking the respective terminals of the printing machines with the common ink density measuring installation.

In accordance with an additional feature of the invention there is provided a protocol printer that may be connected to at least one channel of the interface multiplexer for providing a printed protocol "listing" with ink distribution values that are acceptable for manual insertion directly into the inking unit of a printing machine.

In accordance with an added feature of the invention, there is provided computing means for controlling the central ink density measuring installation and data transmission channels between the computer means and the terminals that control the printing machines which includes a computer comprising a central processing unit and memory for storing control programs interposed between the ink density measuring installation and a multiplexer connected to the printing machines.

In accordance with yet another feature of the invention, there is provided computing means for automatically recognizing assignment of the respective printing machines to the central ink density measuring installation which is advantageously included in the computer described hereinabove.

In accordance with yet a further feature of the invention there is provided means for selecting and varying the instantaneous assignment of a respective printing machine to one of the channels of the multiplexer which includes logic circuits responsive to instructions stored in the computer memory. The means for selecting and varying the instantaneous assignment relate to the means for selecting and varying the assignment or "association" between the ink density measuring device and the printing machine selected to do a specific printing job.

In accordance with yet an additional feature of the invention, there is provided a data carrier for each of the printing machines for correspondence with the central ink density measuring installation, the data carrier having data thereon that are specific to the respective printing machine and to all jobs printed thereon and operate to selectively coordinate the association between a respective printing machine and a respective printing job.

In accordance with yet an added feature of the invention, the data carrier is a diskette containing the data for a respective printing job.

In accordance with an alternate feature of the invention there is provided for each assignment between a printing machine and for a printed product, a printing control strip on the printed product, wherein the strip has a plurality of identifying measurement fields recognizable by the central ink density measurement installation by having at least one either full-tone or no-tone field which, correlated with corresponding data in the data carrier, serve for automatically determining the assignment to the respective printing machine.

In accordance with still a further feature of the invention there is provided means for performing a positioning and a recognition procedure, respectively, in the central density measuring installation for declaring the particular measuring field of a previously prepared printed product to be used for later identifying the particular printing machine on which the printed product is to be printed.

In other words the invention relates to a system for associating a single ink density measuring device with a group of printing machines that are typically of different construction or models. The data that represent the ink distribution and density for a printing job are called the job data and are obtained from the ink density measuring device as job data. These job data, naturally, must be converted to machine setting data, which must be computed to match the printing machine assigned to do the printing job. The job data may typically be stored on a magnetic cassette, but the method and medium of storage is immaterial to the scope of the invention. The computation of machine setting data from the job data, is performed by the computing means.

The computing means may also serve to control the ink density measuring device, and compute the ink volume required for each color and ink zone.

As mentioned hereinabove, the invention also includes an identifying method for automatically recognizing the association between the job data and the printing machine selected to print the job, as will be described in more detail in the following more detailed description. The identification method includes the use of an identifying measuring field, which is, briefly stated, a selected one of a plurality of fields on a test stripe having a plurality of fields, that is left either completely bare ("no-tone") or completely full-tone thereby marking them as being identification fields. The particular field on each print, that is left bare or full-tone designates by its position the particular machine chosen for the printing of the job. For example, if there are n printing machines in the printing establishment, there will typically be at least n differently positioned identifying fields in the test stripe, each one identifying one particular machine. Accordingly, when a set of machine setting data are produced, the data also includes the number of the identifying field of the test stripe.

Other features which are considered as characteristic for the invention are set forth in the appended claims.

Although the invention is illustrated and described herein as embodied in a multimachine operating system for remotely controlling printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the accompanying figures of the drawing which in diagrammatic and schematic form show a multiprinting-machine operating system for remotely controlling printing machines constructed in accordance with the invention.

BRIEF DESCRIPTION OF THE DRAWINGS

FIG. 2 is a flow chart showing the sequences of steps to be traversed in operating the multimachine operating system according to the invention;

DESCRIPTION OF THE PREFERRED EMBODIMENTS

Figure 1:
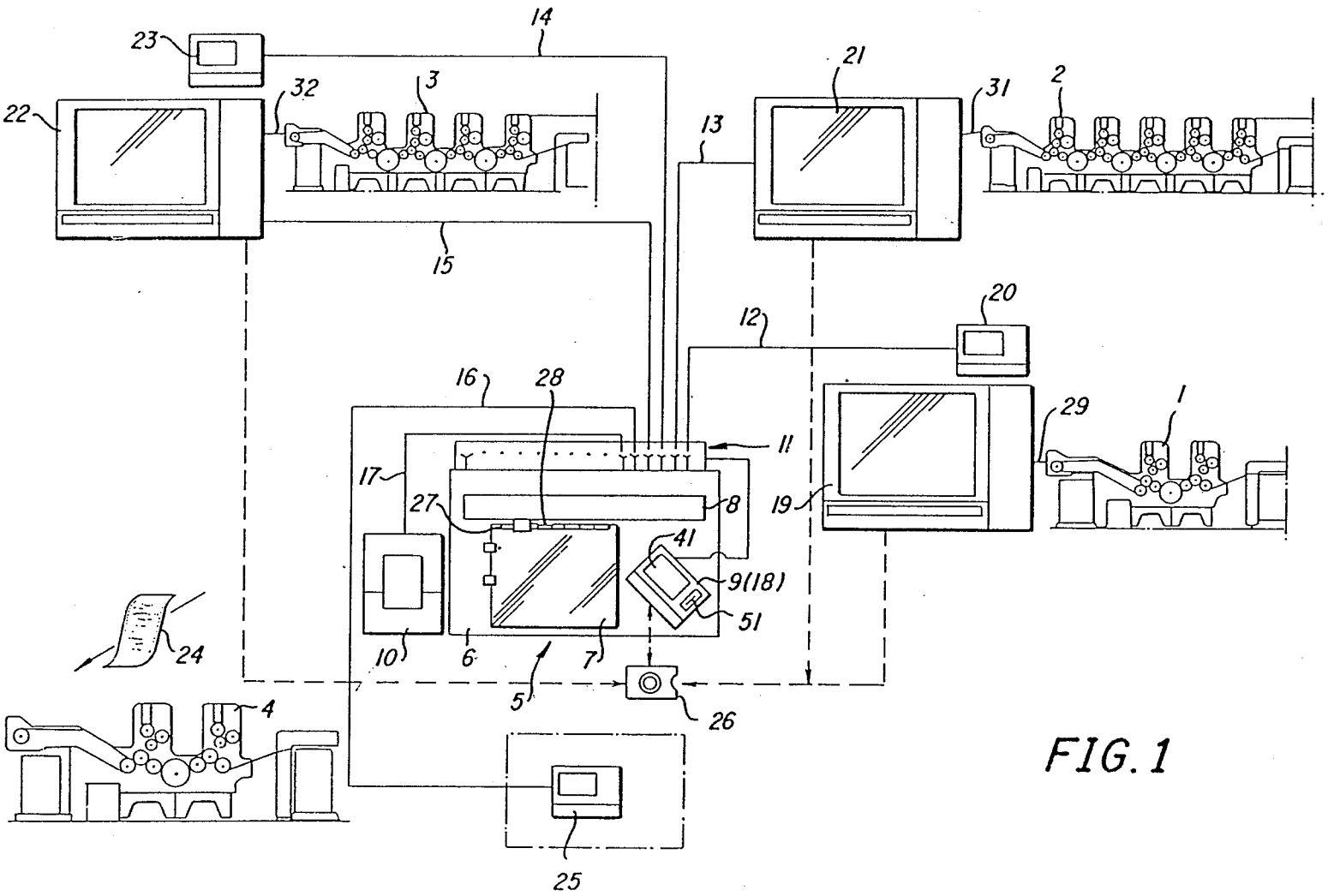
FIG. 1 is a block diagram of the multimachine operating system according to the invention showing four printing machines having a common ink density measuring desk connected with a computer and a multiplexer with data channels to the individual control desks and/or data terminals for the machines.
Figure 1A:
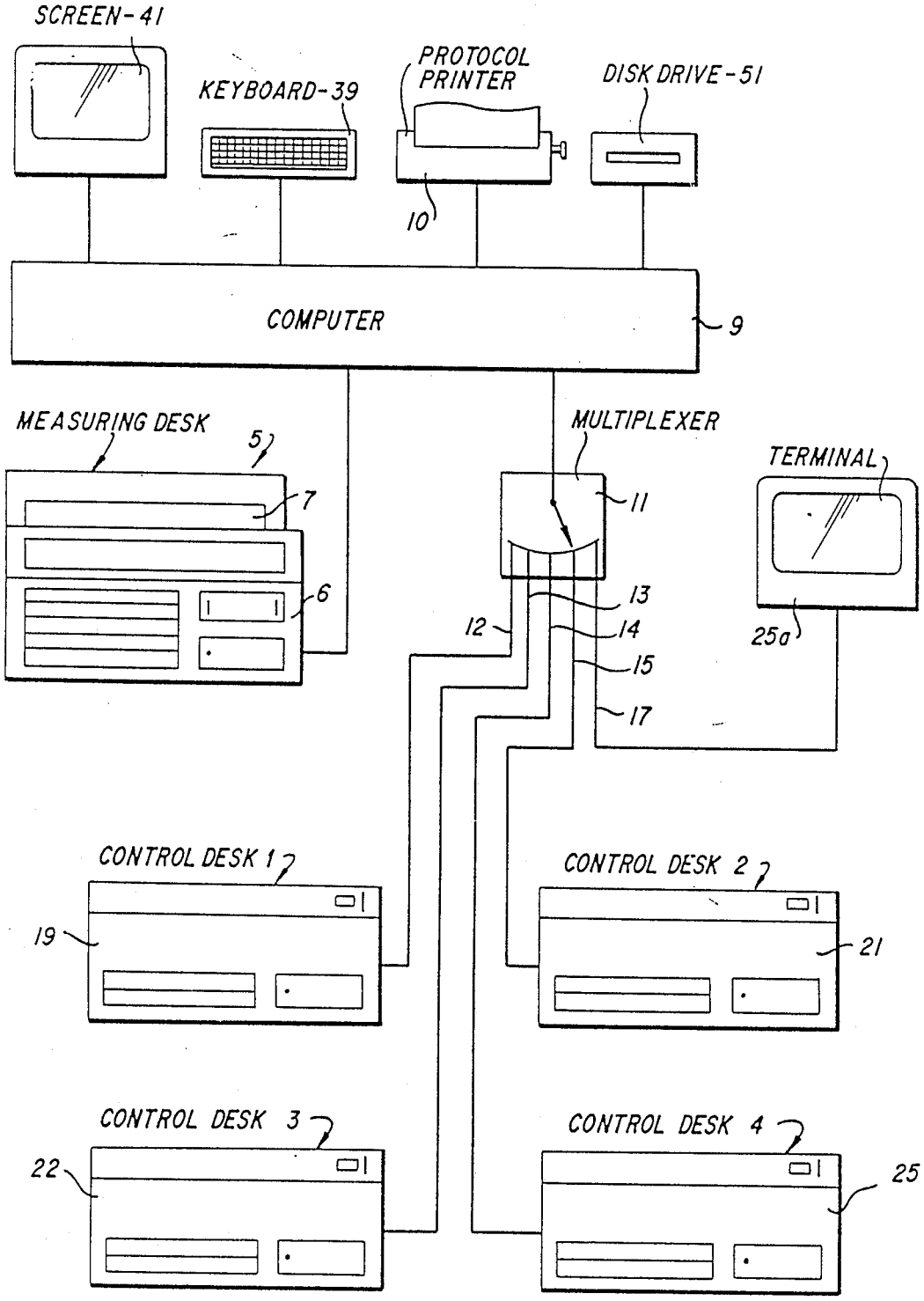
FIG. 1*a* is a basic simplified block diagram of a printing plant arranged according to the invention showing the basic data connections.

FIG. 1*a* shows a computer 9 having connected thereto as peripherals a display screen 41, a keyboard 39, a protocol printer 10, and disc drive 51, which may be a drive for a diskette or a fixed disc.

The computer is further connected to an ink density measuring desk 5 described in more detail below, and a data transmitter or multiplexer 11 serving for transmitting data between the computer 9 and anyone of four printing machine desks 19, 21, 22 serving respective printing machines, and a central general control desk 25.

Referring now to FIG. 1 which is a more detailed block diagram than FIG. 1*a*, a central ink density measuring installation 5 is shown stationed at a location which is as central as possible within a pressroom between printing machines 1 to 4. The ink density measuring installation 5 is formed primarily of a measurement table 6, whereon a printed product 7 is laid, with a computer-supported densitometric measuring device 8, a personal computer 9 with a viewing screen and an electronic recognition system 18 which is part thereof and a protocol printer 10. The central ink density measuring installation 5 is furnished, furthermore, with a multichannel interface multiplexer 11, having a number of data channels 12 to 17, the number of which depends upon the number of printing machines to be served by the system.

The operation of a multiplexer is well known in the electronic art as a means for providing a time-shared variable association between a single data source and a plurality of data receivers, and is described in many text books on electronics, e.g. in McGraw-Hill's Concise Encyclopedia of Science and Technology under "Electrical Communications".

The printing machine 1 is equipped with a control desk 19 connected to the printing machine 1 via data link 29 and a viewing screen terminal 20 connected by data channel 12 to the measuring desk 5. The printing machine 2 is differently arranged in that it has only a control desk 21 connected directly to the printing machine 2 via data link 31 but no viewing screen terminal. The printing machine 3 is connected via data link 32 with the control desk 22 which is in turn connected via data channel 15 to the measuring desk 5, and a viewing screen terminal 23 connected via data channel 14 to the measuring desk 5. Adjustment of the inking process of these printing machines 1 to 3 is possible from the control desks 19, 21 and 22, respectively. The printing machine 4 is typically of an older type neither furnished with a control desk nor with a viewing screen terminal but is, for example, provided with a still manually adjustable blade ink ductor of conventional construction, for control of the ink supply.

The interface multiplexer 11 permits direct measurement value transmission from the central ink density measuring. installation 5 of inking data to the various printing machines 1 to 3. For this purpose the central ink density measuring installation 5 is coupled via the first channel 12 of the interface multiplexer 11 with the viewing screen terminal 20 of the printing machine 1 exclusively for the purpose of visually showing the machine operator the transmitted data. The operator of the printing machine 1 can thus, see displayed on the terminal 20 all the measurement values for a printed product, such as change in color tone value, contrast, the degree of slipping of the paper and especially full tone ink density measurement values and ink density nominal values as well as differences between ink density measured values and previously entered nominal (or desired) values, which provide the operator with reference values for adjustment of the printing machine's ink metering elements using the control desk 19. It follows that since the control desk 19 is not directly electrically coupled with the central ink density measuring installation 5, this visual method represents an economical coupling arrangement which is available especially for retrofitting and providing previously existing control desks of earlier types of construction not equipped for direct electrical coupling. This form of coupling with the measuring installation is designated visual coupling.

The second printing machine 2, on the other hand, is connected via the test desk 21 directly electrically via the second data channel 13 of the interface multiplexer 11 to the central ink density measuring installation 5 for the purpose of receiving data therefrom. In this case the nominal and measured values received from the ink density measuring installation 5 are further processed automatically for the operator of the printing machine 2 in the control desk 21 to produce adjustment values in the form of follow-up recommendations for adjusting the ink supply. In an otherwise non-illustrated and not further described display of the control desk 21, the operator can call up in addition to a view of the ink profile i.e. the setting of the ink metering elements, also the ink density trend as measured on subsequent, successive prints as well as follow-up recommendations for ink distribution adjustment. The operator then has the ability of accepting these follow-up recommendations and, by operating a "Command Execute" key after the introduction of a follow-up command, adjust the ink adjusting members continuously, automatically or, instead, only once. The operator may, however alternatively adjust only individual ink adjusting members by means of manual introduction of remote-controlled commands. Due to the automatic further processing of the data transferred from the central ink density measuring installation 5, the additional provision of a viewing screen terminal normally becomes superfluous. This direct electrical coupling arrangement may accordingly be used with printing machines that are furnished with suitably compatible control desks.

As described for the printing machine 3, it is possible also to have a double coupling i.e. both an electrical coupling with the control desk 22 as well as a visual coupling with the viewing screen terminal 23. In this case the operator of the printing machine 3 has the possibility of receiving in addition to a visual display of the ink density deviations in so-called graphic form, alternatively also a numerical representation of all of the measurement values.

A central control terminal 25 is connected to the fifth data channel 16 of the interface multiplexer 11 and is stationed, for example, in the vicinity of the supervisor of the pressroom, so that he has the possibility of supervising it and in this case he can always directly monitor the inking of the individual printing machines. A separate protocol printer 10 is controllable via the sixth data channel 17 of the interface multiplexer 11. The printer 10 issues protocol printouts whereon all the measured data is printed, which can also be shown on the viewing screen terminals 20, 23 or 25.

In printing machines of older construction type with the aforementioned still manually adjustable blade ink ductor, which is furnished neither with a control desk nor with a viewing screen terminal, the operator can place the ink-feed data (protocol print-out) 24 of the protocol printer 10 in the form of a printed paper strip showing numerically all the ink feed data required for adjusting ink ductors, directly at his printing machine 4 and manually adjust them from the printed protocol values. The capability thereby is provided to use the central ink density measuring installation 5 effectively also for older printing machines without any automatic aids, and thereby more rapidly optimize the ink distribution of those machines.

Because printed products 7 of any desired format with respectively different printing control strips 27 of various control systems are densitometrically measured on the central ink density measuring desk 5, there is provided for each printing machine coupled directly with the central ink density measuring desks 5 a data carrier 26 dedicated to that printing machine, preferably in the form of an application diskette 26. Each of these diskettes 26 contains the entire listing of all of the permissible types of printing control strips which may be used in the respective printing shop or plant, all standard nominal values and tolerances and so forth, as well as the specific application programs, and job data.

The concept of a data carrier relates to the means for moving ("carrying") the printing machine setting data from the measuring desk 5 with the computer 9 to the respective printing machine. As contemplated, the data carrier can be a magnetic tape, a data cassette or a magnetic diskette, as described in more detail hereinbelow. It follows that the data carrier can also be the data channels 12, 13, 14, 15, 16 and 17 between the multiplexer 11 and the printing machines, seen in FIGS. 1 and 3. Another data carrier included in the inventive concept is the printed paper strip, the so-called protocol strip 24, shown in FIGS. 1 and 3. The printed protocol strip may be taken manually from the printer 10 to the printing machine and the printed data may be manually inserted into the machine control panel e.g. via a keyboard or dials. Again, the precise method of transmitting the data from the measuring device to the printing machine is immaterial to the scope of the invention, since the invention is not directed to the particular methods of transmitting or "carrying" the data.

The control strip is simply a strip of fields printed in each test print outside the normal image area. These fields have different purposes in calibrating the ink distribution. As part of applicant's invention, a number of fields are provided for identification purposes, for example, by permanently associating each printing machine with a particular numbered identification field representing the corresponding machine number, or by providing an association established simply by a "declaration" in the job data set, which provides a flexible association between the job data and any suitable printing machine,-instead of a fixed association.

In starting a printing job, all the specific job information required for the respective printing job, is inserted into the computer during a starting dialogue chosen from a menu of dialogues presented on the monitor screen 41 of the computer 9. Thereby, in later adjustments, if necessary, reference need only be made back to the job information stored on the diskette 26, for the repeated density measurements. After each ink density measurement, the specific job measurement values are again stored on the diskette 26.

In order to provide an automatic checking of the correct assignment between the measurement data stored on the diskette 26 and the corresponding printed product 7, there is provided, as mentioned hereinabove, for each printing machine on each printing job, an identification field 28 on the printing control strip 27 (FIG. 1) on a test print or on the printing plate which is used only for identification purposes. Typically, the identification field provided is used for visual review of the plate copy control and as such is used as an identification field. This identification field 28, before beginning the job, can be marked as being unassigned by being made into either a full tone field on the printing plate by means of a covering lacquer, or into a white field by etching and, during the starting dialogue, in aforesaid starting dialogue of the densitometric measuring desk 8, the identification field can be declared as such as part of the job data.

In other words the starting dialog includes a positioning and a recognition procedure for declaring the association between a given printing job and the selected printing machine. This association can be established by "declaring" the association between the data set, a selected identification field on the test strip, and a selected machine. By that means a flexible association can be provided, so that the test print can have on of the plurality of identification fields made into a specific identification field by making it either "full-tone" or "no-tone" by respectively masking it or etching it on the test print.

It should be noted that the test print may be a thin metal foil instead of a print on paper, for example, of which one is provided for each of the three basic colors. The such prepared identification field can now, by "declaration" during the starting dialog be declared to represent anyone of the printing machines selected for the printing job. It follows that such "identification by declaration" provides flexibility. This flexibility is desirable because, as described hereinabove the identification field can be prepared in a reproduction department of the printing establishment instead of the printing room, ahead of the time, for printing the job. In this way, when the test print is to be printed it is placed on the table of the measuring desk and scanned, in the positioning and recognition procedure, during which the identification field is recognized and its position is recorded. The identification field is then by "declaration" entered manually on the computer keyboard, and thereby associated with the particular printing job and a specific printing machine.

The declaration process simply includes inserting the codes and numbers into the computer, via the keyboard under control of the initialization "menu" of the starting dialog, as is customary in preparing a task on an interactive computer terminal.

The identification field 28 is as stated above, one of the several fields in the printing control strip 27, which are normally not used for measurement purposes, and are therefore on record as identification fields in the computer memory.

The identification fields can, for example, be visual control fields that were used earlier in the preparation of the printing plate and are therefore no longer needed for visual control.

When one of these identification fields on the printing plate are recognized as identification fields during the starting dialogue when the test print is placed on the measuring table for the initial initiation procedure, by means of placing the measuring heads over the identification field, the machine operator can immediately recognize it as an identification field, since the field is either full-tone or no-tone (e.g. black or white tone). By performing the start dialogue, the location of the identification field is declared in the computer memory and on the diskette for the respective printing job, and at the same time, the measured value of the ink density of the identification field, being either full-tone or no-tone, is recorded in computer memory and on the diskette. The printing machine operator selects the identification field so that no other printing job being processed has an identification field in the same location.

The hereinabove described conversion of an unused measurement field into either a full-tone or a "no-tone" field simply serves to help the machine operator to position the field during the manual initiation procedure during the start dialogue in relation to the measuring heads.

Since the multiplexer has a limited number of channels, advantageously eight channels, the chances of erroneously mis-identifying the diskettes, is further limited. It is, therefore, advantageous to provide a fixed assignment of channels 32 to the control consoles 19, 21, 22 and so forth or the terminals 20, 23 ... 25, respectively, with a corresponding identification field on the control strip, so that a machine operator using a certain control desk or terminal always uses the same identification field, repeatedly.

If a fixed assignment between a printing job and a particular printing machine is desired, such a one-to-one administrative assignment may be used to assure that a particular printing job is always run on the same machine.

In other words, using such a fixed channel assignment is a manual safeguard. It is, nevertheless, also possible to let the proper assignment of a diskette to a printing job be handled by the system in the way that, after the location of the identification field and its measured value has been entered into the computer during the initiation dialogue and stored therein, such that an identification field location is always for each machine the last entry. It should be noted, that in this case of automatically supervising the assignment, the computer recognizes only the assignment of a printing job to a printing machine (or its control desk or terminal) on the basis that a certain measured value in the assigned location of the identification field actually is found there, or otherwise, in the case of a wrong assignment, there would be no (full-tone or no-tone) value in that location.

Since each machine and/or each printing job, in the case of a mis-assignment would have the identification field in different locations, it follows that it is impossible to encounter a mis-alignment without immediately recognizing it. FIG. 2 is a flow-chart that shows the sequence of steps that are performed by the elements of the invention in the course of performing the various tasks that have been described, in more general terms hereinabove. Each step is assigned a three-digit reference numeral, and the steps involved in the various types of tasks are given the same first digit; e.g. the preparation of job-specific data are shown in the step series 304–311.

Before describing the various tasks to be performed, it will be helpful to summarize briefly the objects of the various tasks to be performed.

The primary object of the invention is that of providing means for using a single common measuring desk, generally at 5 in FIG. 1, for a group of individual printing machines 1, 2, 3 and 4 that may typically be of different construction and/or model numbers. A measuring desk is typically quite expensive and space consuming and is not used all the time for a single printing machine, or a single printing job. It therefore makes good sense to share a common measuring station among a group of printing machines.

In order to attain good quality in producing a multicolor printed product, it is necessary to determine the proper values for ink distribution for the printing machine selected to do the printing. It is therefore necessary to determine the amount of ink, of the various basic colors used, to be distributed to the printing mechanism. It is also necessary to determine the ink distribution in the various parallel ink zones of the printed product. This ink distribution is known as the ink profile for the printed product. There is a profile for each color. This ink profile is determined on the measuring installation 6, by placing a known good copy or a master of the print 7 on the measuring desk 5. The desk 5 has a measuring arm 8 that can slide across the print 7 on two parallel tracks (not shown). The measuring arm 8 contains a string of color sensitive photo cells on its underside and lights for illuminating the print 7. As the arm 8 slides across the print 7 the photo cells scan and measure the color density of each of the parallel ink zones in each of the basic colors. During a scan, the outputs of the photo cells are summed up in the computer 9 connected to the photo cells through appropriate electronic circuits containing analog-to-digital converters, multiplexers and the like. Such measuring desks are well known in the printing industry. A very detailed description of a measuring desk is described in U.S. patent application No. 4,681,455. The present patent application contemplates a conventional measuring desk and the invention is not directed specifically to any particular type or model of a measuring desk, but the desk construction described in the aforesaid U.S. Pat. No. 4,681,455 has been found to be very suitable.

As described hereinabove, it is well known to print a so-called ink color stripe 27 across a test print, which is seen atop the print 7 in FIG. 1. The ink color stripe has a fulltone color field for each of the basic colors for each of the ink zones. The ink color stripe is provided so that the individual photo cells can be calibrated before measuring the print. The amount of ink of each basic color for each ink zone used for each print can be expressed quantitatively in accordance with various existing standards and units. One such standard used is the length, e.g. in centimeters, of a full-tone ink track that corresponds to all the ink required for the printed product in each ink zone. The ink distribution and amount in each of the basic colors are part of the data which are designated job data in the present disclosure. Other job data are the format of the print, i.e. the length and the width, the allowable tolerances in ink distribution, and a job identification code. Briefly restated the job data are all the data that are specific to a certain printing job, regardless of the printing machine on which it has been printed.

It follows that the job data cannot be applied directly to anyone of a number of different types and models of printing machines since the different machines have different methods of controlling ink feed and ink distribution. It is therefore part of the instant invention to present a method that makes it possible to apply a standard set of job data to anyone of existing types and models of printed machines by means of a translation process. The data used in this translation are the machine-specific data, also designated "machine data".

Figure 2A:
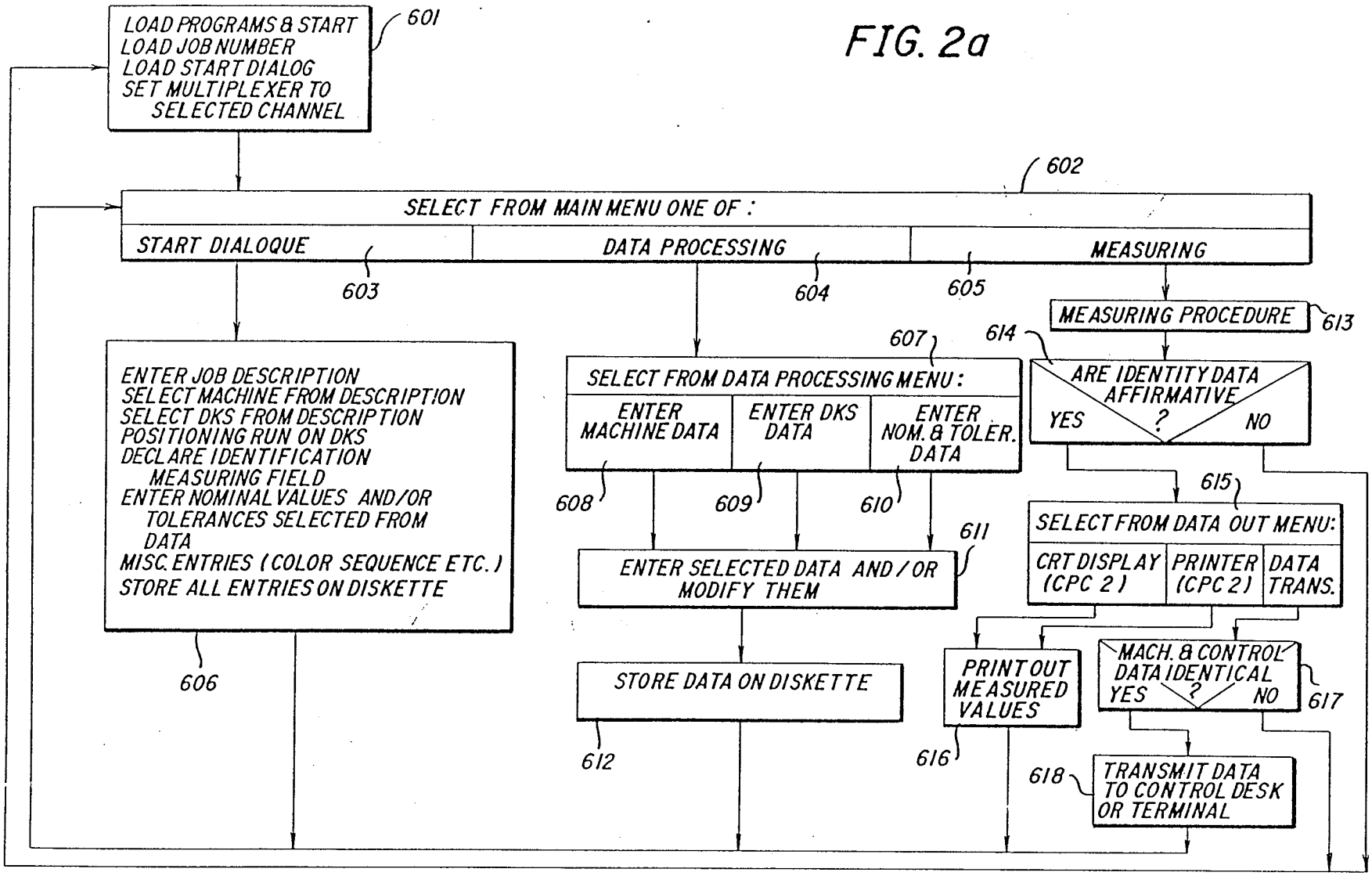
FIG. 2*a* is a basic simplified flow chart of the steps of the operation of the invention.

Using the job data and combining them with machine-specific data, i. e. machine data, abbreviated, in order to produce machine settings for any of the machines used is shown step-by-step in the flow charts of FIGS. 2*a* and 2.

FIG. 2*a* shows broadly the steps traversed in accordance with the invention.

The first step 601 required loading of the various programs required or operating the computer 9 itself and its peripherals, which is the so-called operating program followed by the program for operating the test desk 5, the printing job number, a program including the start dialog, and selecting the appropriate data channels to the printing machine selected. Next, a "Menu" is presented in step 602 on the computer screen 41, from which the operator can select one of the following modes: "Start Dialog" 603, "Data Processing" 604, or "Measuring" 605. If "Start Dialog" is selected, the computer requires the information shown in procedure 606, namely: job description, a selected printing machine which is available and capable of doing the job shown on the screen, a test desk "DKS" if more than one is available, followed by a "positioning run", in which the boundaries of the test print on the test desk are inserted, and a declaration in which the selected printing machine is associated with the particular identification field marked in the test print. Next nominal job data are entered either from a scan on the desk or from an earlier printing of the same job. Finally, all these data are stored on a diskette 26 (FIG. 1). After the steps 606 are completed, the computer returns to the main menu 602 which appears again, from which any of the procedures 603, 604 or 605 can be selected. Assuming the operator wishes to start a printing process, he selects the procedure 604, "Data Processing". After this step, a new "Menu" 607 appears from which he can select one of the procedures: "Enter Machine Data" 608, "Enter DKS Data" 609 (i.e. the measured data from test desk, or "Enter Nominal Data" and "Tolerance Data" 610. The latter data determine the degree of color tolerances allowed for the particular printing job. After entering the machine data the computer applies the machine data to the nominal data or the measured data and produces the machine settings later to be transmitted to the selected machine via the appropriate data channel 12, 13, 14 or 15 of FIG. 1. An intermediate step 611 is provided for modifying the data if the operator, for some reason, wishes to do so. Finally, the operator can store the data on a disc and save them for later use, or transmit the data to the selected machine via the multiplexer 11, seen in FIG. 3.

The third procedure "measuring" 613, is used to measure or re-measure the color densities of a print, or a new picture, never printed before. If it is a test print, which has had an identity field assigned an "identity data" affirmation step is automatically performed by the computer. If the data identity and the selected printing machine are not confirmed, an error is indicated at the "No" outlet from step 614. If the data are confirmed, a new menu "data out menu" 615 is presented, from which the operator can select a CRT display on screen 41 or a print-out on the protocol printer 10 in step 616. If the operator wishes to start the printing job, he selects step 617 "machine and control data identical" which is a further verification step, which, if affirmative, enables the next step "transmit data to control desk or terminal" 618, to be performed so that printing can start.

Referring now to FIG. 2, which is a more detailed flow chart than FIG. 2*a*, the first step, after Start, 100, is the "Insert Diskettes and Load Programs" 101 and 102, in which the various programs are loaded into the personal computer 9. In this step 102 the computer 9 is initialized by loading all the required various programs into the computer. The programs may be stored on diskettes which contain all the various programs required, such as operational and measuring program, machine data program, the start dialogue program and the various control programs.

After initialization is completed, the display screen of the personal computer 9 shows a main menu of all the various functions (capabilities) that are available, as shown in step 103 indicating "Select Task". In step 104, the operator has selected a task, and for the purpose of describing the operation, it is assumed that the operator chooses to start with a printing job for which he has a master print.

In step 105 he places the master print on the measuring table 6 and proceeds to measure the job.

During the initialization, the measured data are stored on the diskette 26, which subsequently contains, among other data, the job-specific data which are loaded from the computer 9. Subsequently follows other job specific data such as the job identity, consisting of job number and job code, as well as the location of the identification-field. The loading of the identification data is shown in steps 401 and 402 and in step 106 the proper identity of the stored job data are checked for correctness. If the job identity is incorrect, which indicates that the operator has inserted the wrong disc, the next step is step 110 which leads back to the start step and step 101, wherein the operator inserts a correct diskette for the job. If the job identity is found to be correct in step 106, the next step is either step 107, in which the measured job data are printed out on the protocol printer 10, or step 109 in which the job data are transferred to the proper terminal 20, 23 or 25, or to the proper control desk 20, 21 or 22, or the next step may be step 113 in which the job data are simply displayed on the screen of the computer 9.

In case step 109 were chosen, in which the job data were transferred to the data terminal 20, 23 or 25 or to the control desk 19, 21 or 22, the identity of the data may again be checked in step 204. If they are found to be wrong, the operator again goes back to step 101, but if the control data identity are found to be correct the next step is step 111, in which the job data are released to the control desk 19, 21 or 22 or to the terminal 20, 23 or 25. In the next step 112, the job data are entered automatically into the corresponding printing machine 1, 2, or 3, or manually in the case of machine 4.

Starting with step 102, "Program Loading", it is also possible to transfer the job data via the multiplexer 11 by switching it to the proper data channel 12–15 or 17 in step 201, which each corresponds to one of the printing machines 1 to 4 directly or via one of the terminals 20, 23 or 25 or the protocol printer 10. In step 202, the data from the start dialogue are transferred to corresponding control desk 19, 21 or 22 or to terminal 20, 23 or 25. In step 203, the job data such as job number and code, nominal values and tolerances, the location of the identification-field and so on are stored in the appropriate control desk or terminal. In step 204 the identity is checked again and if the identity is found to be correct, the job-data are completed and released in step 111 and in step 112 inserted into the proper machine, as the last step before printing. The proper association between control desks 19, 21 and 22 or terminal 20, 23 and 25 and the corresponding printing machine is stored on all the diskettes as they apply to the printing establishment at hand.

The task of storing of the proper association is shown in the step series consisting of steps 104, 501, 502, 503, 504 and 506, which is performed as follows:

The task is selected in step 104; in step 501 all data are displayed on the screen and if necessary modified. In step 502 the identity of the printing machine and the terminal is inserted, in step 503, the type of the control strip is inserted, and in step 504 the nominal values and tolerances and job standards are inserted; finally, in step 506 all the data are stored in the diskette 26. From step 506, the next step is step 102, from which other tasks can be undertaken as described hereinabove.

Besides the preparation of the mutual machine and terminal association, the code or type of the printing control strip, tolerances and nominal values may be also stored on the diskettes. It follows that these associations need only be prepared once, and can from then on, be copied onto other diskettes, as required. The process of copying the subsequent diskettes is not shown in the flow chart on FIG. 2.

Similarly, any changes in the machine or terminal arrangement, are handled in the same manner.

It should be noted that the job data, that are also stored in the computer 9 and have been transferred to the identification circuit (steps 401, 402) and to the associated control desk 19, 21 or 20 or terminal 20, 23 or 25 (steps 201, 202, 203, and 204) were inserted during the start dialog at the start of a new job as shown in steps 301, 304, 305, 306, 307, 308, 309, 310 and 311, as described hereinabove.

The questions that must be answered by the operator in this start dialog 304 are:

job number and/or description;

machine number and description for the selected printing machine;

control strip 27 number for the control strip type used on the printed product 7 must be determined and inserted;

Positioning of the printed product 7 on the measuring table 8, by means of the control strip 27 must be done. In this process the beginning and the end of the printed product is determined in relation to the machine center line. In this process, the measured values of the color zones of the printing machine may be assigned. Next is the position of the identification-field entered as well as the approximate value of identification-field is stored.

In order to do the positioning, it is necessary to use a printed product 7 produced by the same machine. This printed product need not match exactly the product to be printed, and need not have the precise same coloration.

Nominal values and tolerances must be entered either from the keyboard or from a correctly printed master print and other applicable standards must be entered.

At the end of the initiation dialogue, the computer 9 prepares, from the job number and the time of the day from a clock that is running invisibly in the system, an unambiguous code. All the entered data and codes are next stored in the computer and on the diskette 26.

The initiation dialogue is performed with a diskette that is related to the printing machine in which the printing job is to be performed. Therefore, the job-specific data, after they are transferred to the control desk 19, 21 or 22 and or the terminal 20, 23 or 25 for the corresponding printing machine, as shown in steps 201, 202, 203 and 204, are unique to that job and to that machine, and any other diskette that has been prepared earlier has now become invalid. It is, therefore, also impossible that two different diskettes can be used with the same machine. It follows that the relationship between a job and a machine becomes uniquely represented by the prepared diskette.

In order to describe a normal measuring operation, let it be assumed that a diskette A is present that has just been declared in an initiation dialog and that another job, for example on diskette B, has already been loaded into the computer 9, (obviously the measuring operation could also be made directly after performing the initiation-dialog) reference should now be had to the steps numbered 101 to 113 in FIG. 2, as follows: Diskette B is removed and Diskette A inserted in its place and loaded into the memory of the computer 9 under control of the keyboard. In computer 9, only the job-specific data ar loaded.

In step 102 the various programs, listed hereinabove, (such as operating program, machine description, dialogue, measuring program and so forth) are loaded. Next steps 401 and 402 are traversed, in which the identification data are entered, and next steps 201–204 are traversed in which the data channel from the multiplexer 11 is selected, the job data are entered and stored and checked for proper identity; next in step 105, the job is measured, and next in step 106, the job identity is checked to see if the diskette A belongs to the job just measured in step 105. This identification is done by means of the identification-field 28. Since the location of this measuring-field is stored in the identification-circuit 18, a comparison is made between the expected location value and the measured location value. For each printing job a new measuring-field is selected, either in the reproduction department or in the printing room, so that the identification is always unambiguous. In case a mismatch is determined, it is known that a wrong diskette is used, and the task must be started anew with the proper diskette.

In case a proper match is found, the measured location values will be displayed on the screen of the computer 9, as shown in step 113, or the measured location values can be printed out in the protocol printer as the job data, indicated in step 107, and the job data can be transferred to the respective control desk 19, 21 or 22 and/or the terminal 20, 23 or 25. Before transfer is made, an identity-check is again made in step 204 to insure that the data being transmitted from the diskette are the correct data for that control desk or terminal.

For that purpose, the identification code that was prepared during the initiation dialog is used, as described herein-above. In case of a mismatch, a new start must be made with the proper diskette, and in case of a correct match, the transfer of the data is enacted.

From the control desk, 19, 21 or 22, the job data, recomputed into machine data and reviewed for compliance with tolerances, are entered into the printing machine 1, 2, 3 or 4, which completes the entire measuring and control process.

Figure 3:
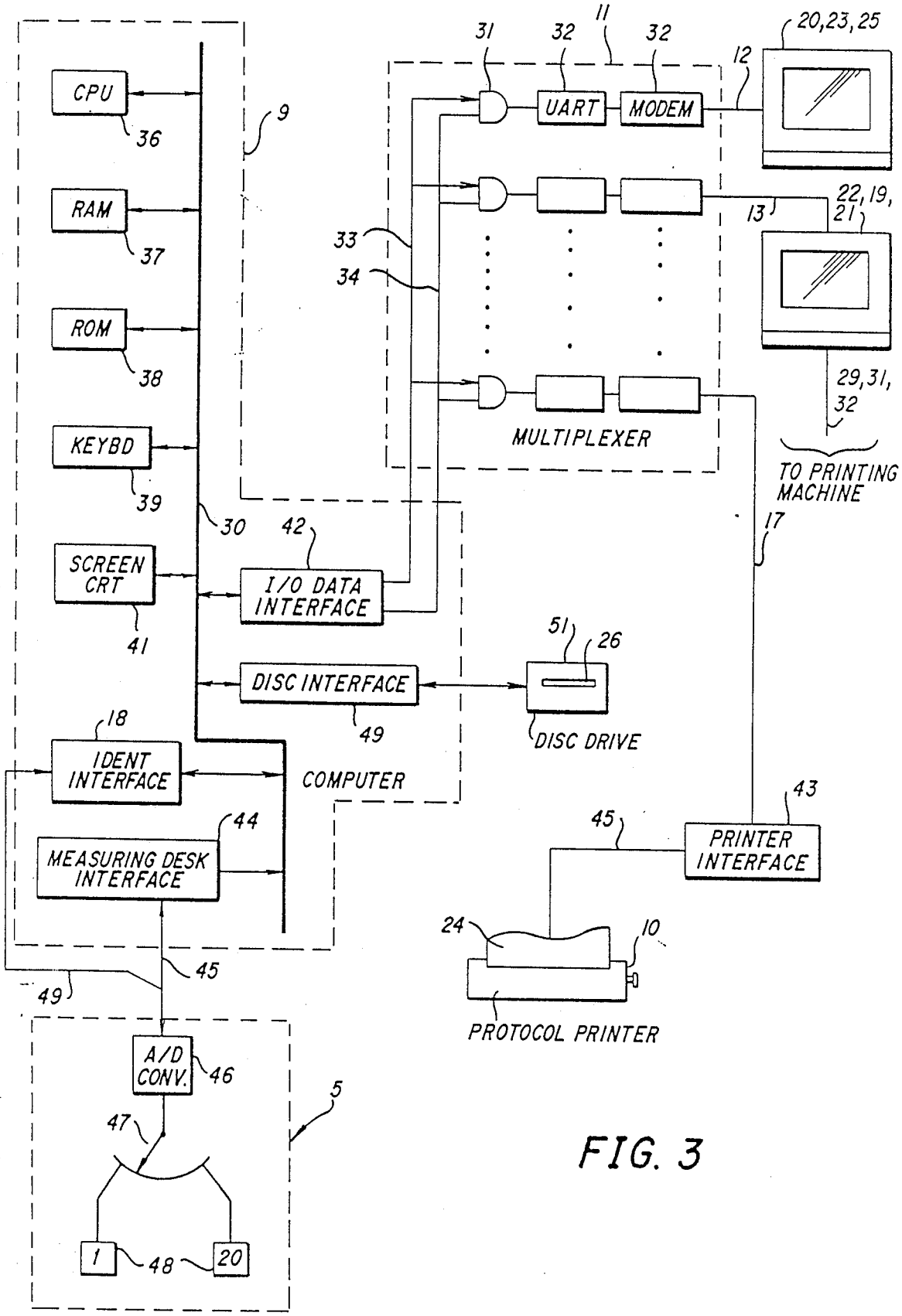
FIG. 3 is a schematic block diagram of the operating system, showing the main components of the system and their mutual cooperation.

FIG. 3 shows a schematic circuit block diagram of the electronic circuits of the invention.

The personal computer 9 consists of a central processing unit (CPU) 36 connected via an internal bus 30 to the random access memory (RAM) 37, a read-only memory (ROM) 38, a keyboard 39 and a CRT screen 41 which are all conventional parts of a personal computer. In addition it is connected through an in/out data interface 42 which connects via an address bus 33 and a data bus 34 to the multiplexer 11, which contains a plurality of multiplexing gates 31, each having an address input connected to the address bus 33 and a data input connected to the data bus 34. The output of each multiplexing gate 31 is connected to a universal asynchronous receive-transmit (UART) circuit **32*a* which in turn connects to a modem 32*b*. The modem transmits and receives data to and from the data channels 12–17 connected to the control desks 19, 21, 22 and the data terminals 20, 23 and 25**.

The modems **32*b* advantageously convert the data to frequency-shift-keyed data (FSK) that are suitable for two-way data transmission on the data channels 12–17**. Such modems are conventional and are available from a number of manufacturers.

The UART's **32*a* convert the data streams to and from the 1/0-data interface 42 into a serial data stream in the start-stop mode, which is widely used in data transmission. The 1/0 DATA interface 42 converts the data received from and transmitted to the data bus 30** into a standard code, of which the so-called ASCII is well known and widely used and is advantageously used in the instant application.

The control desks 19, 21 and 22 and the terminals 20, 23 and 25 contain modems and UARTS corresponding to the ones shown so that two-way data communication on the data channels 12–17 is possible.

A disc-drive interface 49 connects the disc drive 51 with the computer's databus 30, so that data may be stored on or read from the diskette 26 placed in a slot in the disc drive 51.

A printer interface 43 connects via printer connection 45, the data channel 17 with the protocol printer 10, which, on demand, produces a printed strip with all the job data for any job to be printed on a printing machine not having accessible automatic controls.

The measuring desk 5 contains a plurality of optical measuring heads 48 that are connected via a multiplexer 47 and an analog-digital converter 46 to the computer 9 via a measuring desk interface 44 which receives the measured color density data from a printed product 7 in serial digital form to the computer for computing the required ink usage for the print to be printed.

The measuring desk 5 is also connected via an identification data link 49 with the computer bus 30 via an identification interface circuit 18 which measures the print identity of the identification-field 28 in the control ink strip 27, as described hereinabove.

It follows that the invention, as aforementioned, is not limited to the foregoing description and it is self-evident that numerous modifications and variations both structural as well as in principle are conceivable and fall within the scope of the invention.

We claim:

1. A combination comprising a plurality of printing machines and an operation system for operating said plurality of printing machines, at least one of said machines having machine characteristics that are different from the machine characteristics of the remaining machines, said operating system including a central ink density measuring installation for measuring ink density data of a printed product; at least one viewing screen terminal associated with each respective one of said machines for showing said ink density data, at least one control desk coupled with each respective one of said printing machines, electrical coupling means for electrically coupling said ink density data from said measuring installation to said viewing screen terminal; and visual coupling means for visually coupling said ink density data from said viewing screen terminal to each said printing machine; assignment means for assigning a printed product to a respective one of said printing machines, said assignment means including at least one identification field on the printed product, and measuring means included in said central ink density measuring installation for measuring said identification field for automatically identifying said identification field; including a printing control strip printed on said printed product, said printing control strip including said at least one identification field measurable by said central ink density measuring installation; computing means and means responsive to said computing means for performing a positioning and a recognition procedure on said central ink density measuring installation for declaring said identification field as identifying an assignment of said printed product to said respective one of said printing machines; said electrical coupling means including a multi-data-channel transmitter, an output of said ink density measuring installation being connected to said multi-data-channel transmitter for transmitting said ink density data to said viewing screen terminals from said ink density measuring installation; and means for selectively assigning a channel of said multi-data-channel transmitter to each respective one of said printing machines.

2. The combination according to claim 1, including a protocol printer having an input connected to at least one channel of said multi-data-channel multiplexer for providing a protocol printout of said ink density data for manual transfer of said ink density data from said protocol printout to a respective one of said printing machines.

3. The combination according to claim 1, including computing means for processing of data having an input connected to said central ink density measuring installation for processing said ink density data before coupling said ink density data to said viewing screen terminal.

4. The combination according to claim 1, including computing means coupled to said measuring installation for receiving job information required for printing said printed product on said respective one of said printing machines.

5. The combination according to claim 1, wherein said electrical coupling means include a data carrier for coupling said ink density data from said central ink density measuring installation to said viewing screen terminal, and wherein said ink density data include ink density data specific to a respective one of said printing machines and to all printing jobs printed thereon.

6. The combination according to claim 5, wherein said data carrier is a diskette specific to a respective one of said printing jobs.

7. The combination according to claim 1, wherein said identification field is at least one of full tone and no tone for automatically determining that said field is an identification field.

8. The combination according to claim 4, wherein said computing means include means for performing a positioning and a recognition procedure on said central ink density measuring installation for declaring said identification measuring field as identifying said assignment.

* * * * *